US005787055A

United States Patent [19]

Alpert

[11] Patent Number: 5,787,055

[45] Date of Patent: Jul. 28, 1998

[54] CHANGEABLE WALL CLOCK

[76] Inventor: David J. Alpert, 929 N. Astor No. 407, Milwaukee, Wis. 53202

[21] Appl. No.: 618,358

[22] Filed: Mar. 19, 1996

[51] Int. Cl.[6] ..... G04B 19/04

[52] U.S. Cl. ..... 368/223; 368/228

[58] Field of Search ..... 368/28, 29, 41, 368/223, 228, 232–236

[56] References Cited

U.S. PATENT DOCUMENTS

| | | | |
|---|---|---|---|
| 2,132,051 | 10/1938 | Schuttenberg | 360/41 |
| 4,525,077 | 6/1985 | Ketner . | |
| 4,660,992 | 4/1987 | Paul et al. . | |
| 5,018,118 | 5/1991 | Ross . | |
| 5,168,479 | 12/1992 | Lima . | |
| 5,224,078 | 6/1993 | Mallin . | |

FOREIGN PATENT DOCUMENTS

| | | |
|---|---|---|
| 209814 | 6/1960 | Austria . |
| 0169623 | 1/1986 | European Pat. Off. . |
| 2588975 | 10/1985 | France . |
| 2614443 | 4/1987 | France . |
| 2352021 | 4/1975 | Germany . |

*Primary Examiner*—Vit W. Miska

*Attorney, Agent, or Firm*—Ryan, Maki, Mann & Hohenfeldt

[57] ABSTRACT

A changeable wall clock system includes a single clock base used in conjunction with a number of different clock dials. The clock dials can be stacked atop one another in the clock base with only the uppermost dial visible. By changing which dial is uppermost, the visual appearance of the clock can be readily changed. The clock dials that are not visible can be stored in the clock base until they are needed. A tab and slot arrangement secures the multiple clock dials in the clock base. A removable frame helps hold the assembled clock together. By including multiple frames of different appearance in the system, further variety in the appearance of the assembled clock can be obtained.

10 Claims, 2 Drawing Sheets

CHANGEABLE WALL CLOCK

BACKGROUND OF THE INVENTION

This invention relates generally to wall clocks and, more particularly, to wall clocks having removable or replaceable dials.

Wall clocks are well known devices in the timekeeping art. Today, wall clocks function not only as timekeeping devices but as decorative objects as well. Given the extreme accuracy, reliability and economy that can be realized with modern, battery powered, quartz-based movements, modern wall clocks are more or less equal in terms of technical performance. Accordingly, consumer purchasing decisions today are based as much if not more so on considerations of how the clock looks as on how well it works.

With the advent of highly accurate, reliable and low-cost quartz movements, price and appearance are now the primary considerations in consumer purchasing decisions. From a manufacturer s point of view, the challenge is to offer wide variety in the styles and designs of the clocks that are made available while keeping manufacturing costs low. Variety in the available line tends to run counter to manufacturing economy, which generally favors large volume manufacture of the same thing over and over.

One known approach to providing stylistic variety in wall clocks is through the use of changeable dials. Simply by changing the dial, the appearance of a wall clock can be changed dramatically. Various forms of clocks and watches having changeable stylistic features are shown in the following U.S. and foreign patents:

| Patent No. | Name | Issue Date |
|---|---|---|
| US 5,224,078 | Mallin | 06/29/1993 |
| US 5,168,479 | Lima | 12/01/1992 |
| US 5,018,118 | Ross | 05/21/1991 |
| US 4,660,992 | Paul et al. | 04/28/1987 |
| US 4,525,077 | Ketner | 06/25/1985 |
| US 2,614,443 | Cuvelier | 04/23/1987 |
| US 2,588,975 | Jacob | 10/22/1985 |
| DE 23 52 021 | Gopfert | 04/20/1975 |
| EP 0 169 623 | O'Donoghue | 01/29/1986 |
| AT 209,814 | Silberman | 06/25/1960 |

In some of these designs, the appearance of the timepiece is changed by changing the transparent cover that overlies the face of the clock or watch. In other designs, the dial card of the watch or clock is changed to change the appearance of the timepiece. Although effective in changing the appearance of the clocks and watches, none of these designs is optimally suited for periodically and systematically changing the clock appearance in an organized, systematized manner.

SUMMARY OF THE INVENTION

The invention responds to a need for an organized and systematized approach to changing the appearance of a wall clock to suit different and changing decorative needs, moods and desires. The invention provides a changeable wall clock system that enables the wall clock to be changed in appearance easily and conveniently, and with sufficient flexibility to suit a variety of anticipated and unanticipated decorative needs.

One advantage of the invention is that a variety of different dials can be contained or stored in the clock body while they are not in active use. This avoids the need for separate storage of the dials and avoids the inconvenience and risk of loss associated with such separate storage. Another advantage of the invention is that particular dial and frame combinations can be selected in advance (for example, to match the different seasons of the year) and organized in a single system that is changed in an organized, systematized way throughout the year.

The invention provides a changeable wall clock system having a clock base, a plurality of clock dials and structure for mounting the clock dials in stacked relationship in the base with one of the clook dials uppermost and the remainder of the clock dials disposed in a storage position between the uppermost clock dial and the clock base.

The invention also provides a changeable wall clock having a clock base, a clock movement mounted on the clock base, a transparent cover mounted over the clock base and a plurality of clock dials mounted in the clock base between the clock base and the transparent cover in overlying stacked relationship to each other with one of the clock dials visible through the transparent cover and the remainder of the dials disposed between the visible dial and the clock base.

The invention also provides a changeable wall clock having a clock base, a clock movement mounted to the clock base, a transparent cover mounted over the clock base, a removable frame positioned around the clock base and the transparent cover for removably securing the transparent cover to the clock base, a first clock dial card mounted in the clock base and visible through the transparent cover, and a second clock card separate from the first clock card mounted in the clock base under the first clock card so as not to be visible through the transparent cover, the first and second clock dial cards being interchangeable so that, after removing the removable frame and the transparent cover, the second clock dial card can be placed in a visible position and the first clock dial card placed in a position that is not visible through the transparent cover when the transparent cover is thereafter mounted on the clock base.

In one embodiment, the clock dials are mounted in the clock base by means tabs and slots.

In one embodiment, the tabs are formed on the clock dials and are received in slots formed in the clock base.

In one embodiment, the slots formed in the clock base are sufficiently large to permit multiple clock dials to be stored in the clock base.

In one embodiment, a removable frame is provided around the clock base.

In one embodiment, a plurality of removable frames are provided, each having a different visual appearance.

In one embodiment, a plurality of differently appearing clock dials are provided along with a plurality of differently appearing frames so that the appearance of the clock can be changed to suit changing seasons, changing months, changing holidays and/or changing moods.

It is an object of the invention to provide a changeable wall clock system that can be changed in appearance in an organized, systematized manner.

It is a further object of the invention to provide a changeable wall clock system that provides wide decorative variety in combination with user convenience and manufacturing economy.

It is a further object of the invention to provide a changeable wall clock system that minimizes the risk of losing system components that are not in active use.

It is a further object of the invention to provide a changeable wall clock system wherein the appearance of the clock can be changed significantly without changing the underlying shapes of the manufactured components.

BRIEF DESCRIPTION OF THE DRAWINGS

The features of the present invention which are believed to be novel are set forth with particularity in the appended claims. The invention, together with the further objects and advantages thereof, may best be understood by reference to the following description taken in conjunction with the accompanying drawings, wherein like reference numerals identify like elements, and wherein:

DESCRIPTION OF THE PEFERRED EMBODIMENT

Figure 1:
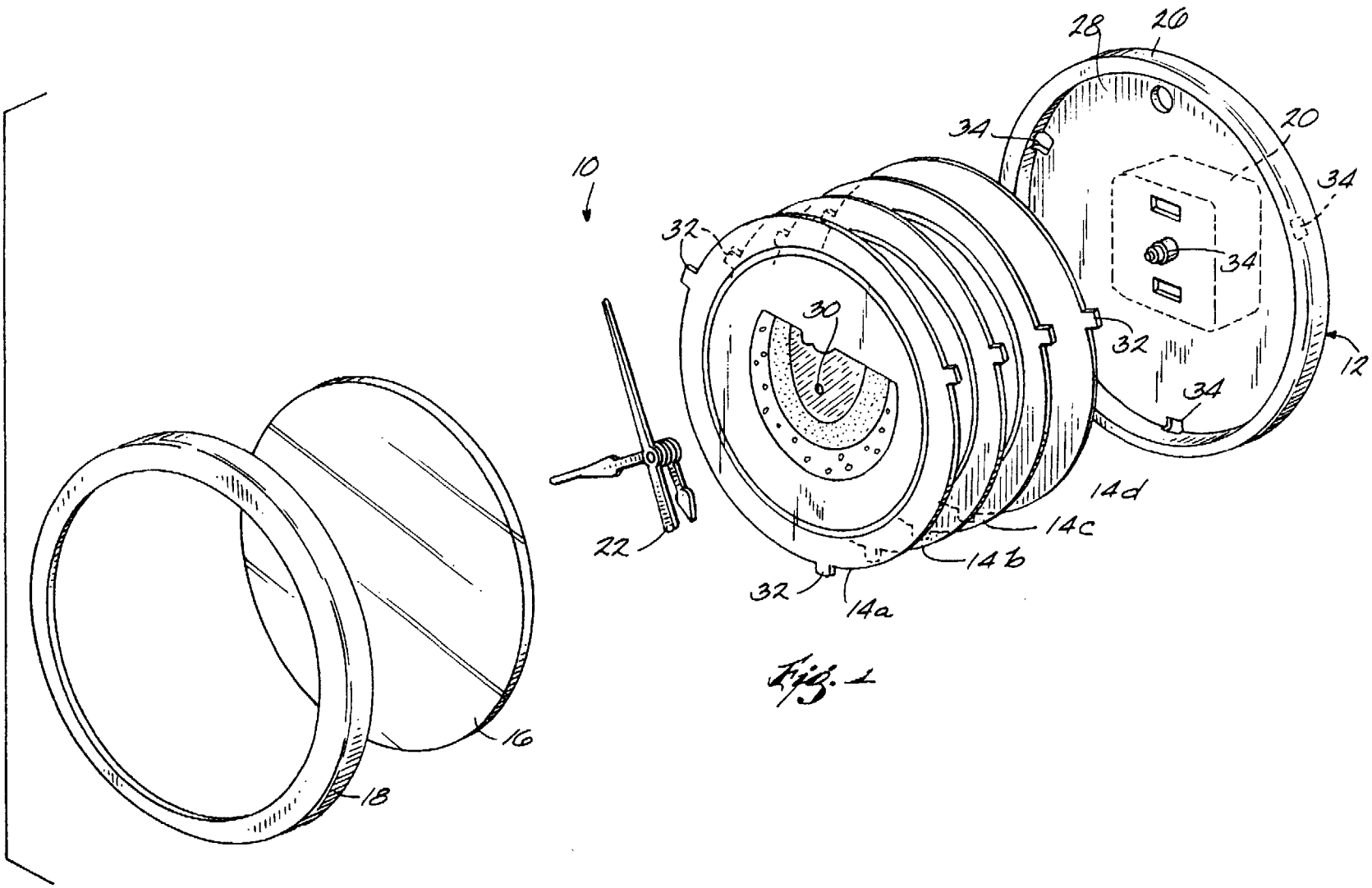
FIG. 1 is an exploded perspective view of a changeable wall clock system embodying various features of the invention.

Referring to the drawings, and, in particular to FIG. 1, a changeable wall clock system 10 embodying various features of the invention is illustrated. The changeable wall clock system 10 provides a convenient, effective and economical means by which clock manufacturers can offer their customers a wide variety of clock styles and appearances to choose from without greatly increasing manufacturing, inventory and distribution costs. In addition, the system 10 provides a convenient, effective and economical means by which owners or users of the system can periodically change the appearance of the clock to suit changing seasons, tastes or moods.

As illustrated, the changeable wall clock system 10 includes a clock base 12, a plurality of clock dials **14*a*–14*d* receivable in the clock base 12, a transparent cover 16 mountable on the clock base 12 over the clock dials 14*a*–14*d*, and a frame 18 removably mountable on the clock base 12 around the cover 16. The system 10 further includes a clock movement 20 mountable on the clock base 12 and a plurality of clock hands 22 removably mountable onto the clock movement 20. Preferably, the clock movement 20 comprises a battery powered, quartz-based movement of known construction having a projecting stem 24 on which the hands 22 are mountable. The clock base 12 and frame 18 are preferably formed of injection molded plastic, and the cover 16 is preferably formed of a transparent, molded plastic. The clock dials 14*a*–14*d*** are preferably die-cut from durable, rigid paper, paperboard or thin cardboard stock that can be printed with designs, scenes, photographs, numbers or other indicia.

As further illustrated in FIG. 1, the clock base 12 is generally circular or disc-shaped in form and includes a raised peripheral or rim portion 26 surrounding a depressed center portion 28. A hole is formed in the center of the center portion 28 through which the clock movement stem 24 extends when the clock movement 20 is mounted on the rear of the clock base 12. The clock dials **14*a*–14*d* are generally circular or disc-shaped and conform generally to the size and shape of the clock base center portion 28. This allows the clock dials 14*a*–14*d* to be received in the clock base 12 within the area bounded by the rim portion 26. Each of the clock dials 14*a*–14*d* also includes a center hole 30 through which the cock movement stem 24 extends when the clock movement 20 is mounted on the back of the clock base 12 and the clock dials 14*a*–14*d* are received in the clock base 12. Each of the clock dials 14*a*–14*d* also includes a plurality of outwardly extending tabs 32 that are received in complementary slots 34 formed in the clock base 12 to removably retain the clock dials 14*a*–14*d* in the clock base 12**.

Figure 2:
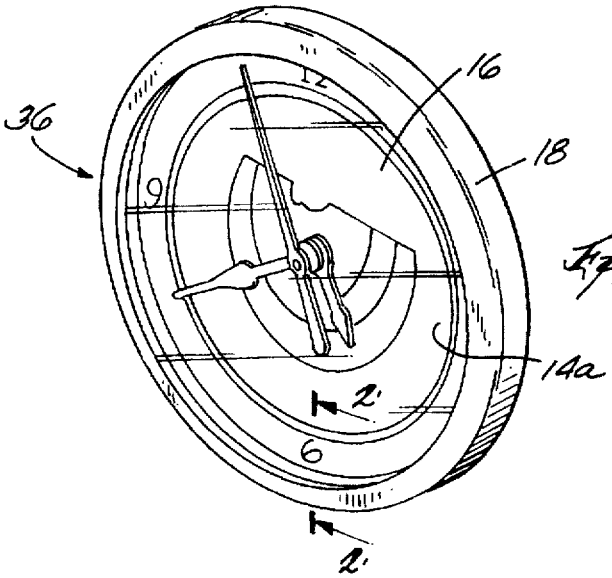
FIG. 2 is a perspective view of an assembled wall clock embodying various features of the invention.
Figure 4:
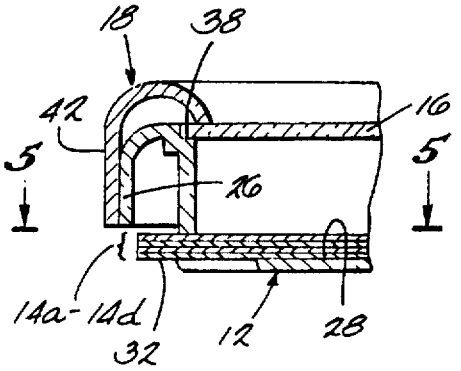
FIG. 4 is a cross sectional view of the assembled clock shown in FIG. 2 taken along line 4—4 thereof showing the clock frame engaging the clock base and further showing a slot and tab arrangement for mounting multiple clock dials in the clock base.

As best seen in FIG. 2, the various components of the changeable wall clock system 10 can be assembled to form a completed, changeable wall clock 36. When so assembled, the various clock dials **14*a*–14*d* are received in the clock base 12 in overlying stacked relationship as best seen in the cross-sectional view of FIG. 4. The transparent cover 16 overlies the stacked clock dials 14*a*–14*d* and is held in place by the frame 18. Preferably, an annular ledge 38 is formed in the clock base rim 26 to provide a supporting surface for the cover 16, and the frame includes an inner lip 40 that presses down against the cover 16 to hold it in place when the frame 18 is assembled onto the cover 16 and clock base 12. As best seen in FIG. 4, the frame 18 further includes an outer lip portion 42 that forms a friction fit with the clock base rim 26 to removably secure the frame 18 to the clock base 12. When the changeable wall clock 36 is so assembled, the uppermost one of the clock dials 14*a*–14*d* is visible through the transparent cover 16** while the remaining, underlying ones of the dials are not visible through the cover.

Figure 5:
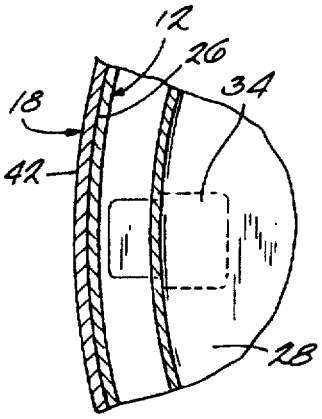
FIG. 5 is a fragmentary rear view of the clock shown in FIG. 2 showing the clock frame engaging the clock base and further showing the slot and tab arrangement for mounting multiple clock dials in the clock base.

The tabs 32 formed in the periphery of the clock dials **14*a*–14*d* are of generally rectangular or square plan form and extend radially outwardly from the periphery of the clock dials. The slots 34 formed in the clock base 12 are similarly shaped and are positioned to receive the tabs 32 when the clock dials 14*a*–14*d* are received in the clock base 12. As best seen in FIGS. 4 and 5, each slot 34 includes a radially inwardly directed horizontal portion 44 formed in the clock base center portion 28 that extends to the clock base rim 26. In accordance with one aspect of the invention, the slots 34, and in particular the horizontal portion 44 thereof, are dimensioned to permit a plurality of clock dials to be mounted simultaneously in the clock base 12 in overlying stacked relationship. In other words, the slots are big enough to let more than one clock dial 14*a*–14*d* be mounted in the clock base at a time. In this manner, the clock dials 14*b*–14*d* that are not in active use (i.e., are not visible through the cover 16) can be stored in the clock base 12 underneath the clock dial 14*a* that is in active use (i.e., visible through the cover 16**).

Figure 3:
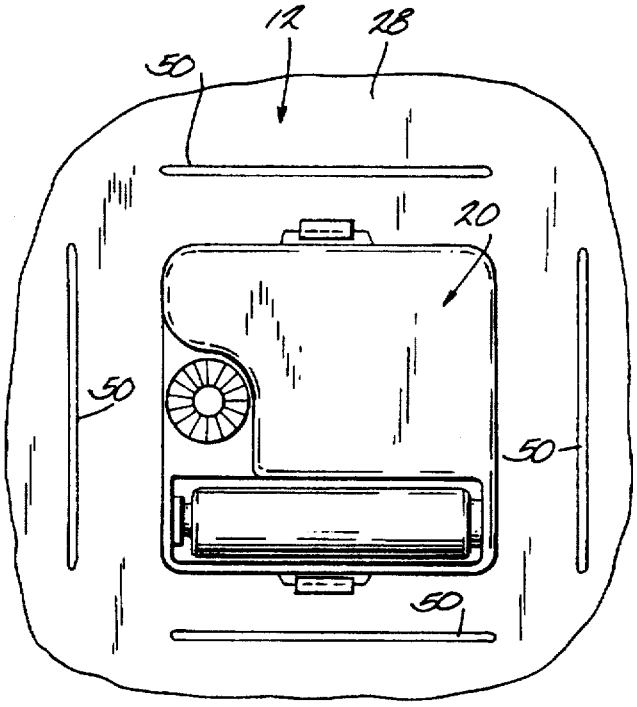
FIG. 3 is a fragmentary rear view of the wall clock shown in FIG. 2 showing an arrangement for mounting a quartz movement in the clock.

The manner in which the clock movement 20 is mounted on the clock base 12 is best seen in FIG. 3. The clock base 12 includes a pair of elongate slots 46 (FIG. 1) that receive complementary tabs 48 projecting from the upper face of the movement 20 on opposite sides of the stem 24. The tabs 48 snap into the slots 46 in known manner to permit rapid an simple assembly of the clock movement 20 to the clock base 12. The hands 22 are then pressed onto the various sections (i.e. hours, minutes, seconds) of the stem 24 in known manner. Preferably, a plurality of webs 50 are integrally molded onto the clock base 12 around the movement 20 to help support the movement 20.

In accordance with one aspect of the invention, the changeable wall clock system 10 includes a plurality of clock dials 14a–14d that are each printed with different designs, colors, scenes, pictures, fonts or other indicia so that each dial has a different visual appearance. By selecting which of the dials is uppermost in the clock base 12 and, hence, visible through the cover 16, the consumer or user can change the appearance of the assembled wall clock 36. To avoid the inconvenience of separately storing (and possibly losing) the clock dials that are not being actively used, these unused dials can be conveniently and safely stored in the clock base 12 under the uppermost dial that is in active use. If and when the consumer or user wishes to change the appearance of the assembled wall clock 36, a different one of the clock dials can be placed uppermost in the clock base 12. The previously used clock dial can be stored in the clock base under the current, uppermost clock dial.

To change a clock dial, the user first separates the frame 18 from the clock base 12. Next the cover 16 is removed. The hands 22 are then removed from the stem 24 thereby permitting the clock dials 14a–14d to be removed from the clock base 12. The user then selects which of the clock dials 14a–14d is to be visible and places this dial uppermost. The remaining dials are stacked below the selected uppermost dial and the stack is then inserted into the base 12 with the tabs 32 being received in the slots 34. The hands 22 are then remounted onto the stem 24, after which the cover 16 and frame 18 are mounted onto the base 12 to complete the reassembly. The process can be repeated whenever the consumer or user feels the need to change the appearance of the clock. Alternatively, the changes can occur as part of a preplanned program wherein the changes occur at predetermined times according to a predetermined plan. For example, the clock dials 14a–14d can reflect each the seasons and can be utilized at corresponding times of the year. Alternatively, the clock dials 14a–14b can be printed with designs, photographs or drawings reflective of various holidays or months and displayed at appropriate times of the year. Further flexibility can be achieved by providing a plurality of frames 18 of different colors or shapes. By utilizing various combinations of clock dials and frames, a variety of appearances can be achieved using the same basic structures.

The changeable wall clock system 10 herein shown and described provides great variety in the possible appearance of the assembled wall clock 36. Visually, the variety is obtained by printing different designs, colors, graphics etc. on the clock dials and by using different colors of plastic in the frames 18. From a manufacturing standpoint, however, these items are essentially the same regardless of their different appearances. Thus, the system provides great flexibility in the visual appearance of the assembled wall clock 36 while retaining the efficiencies and economies that result from mass manufacture of unchanging components.

It will be appreciated that the system herein shown and described can be implemented in different forms without departing from the invention in its broader aspects. For example, although four clock dials 14a–14d are shown, the actual number of clock dials used in the system is not limited to four. A greater or lesser number can also be used. Similarly, the shape of the dials is not limited to circular, and the system can be adapted to clocks having a square, rectangular, oval or other configuration. Similarly, the number and precise location of the tabs 32 and slots 34 is not critical. Accordingly, the preferred embodiment shown and described herein is meant to be illustrative rather than limiting.

While a particular embodiment of the invention has been shown and described, it will be obvious to those skilled in the art that changes and modifications can be made without departing from the invention in its broader aspects, and, therefore, the aim in the appended claims is to cover all such changes and modifications as fall within the true spirit and scope of the invention.

I claim:

1. A changeable wall clock comprising:

a clock base having a rear panel and an open end opposite said rear panel;

a clock movement mounted to said clock base adjacent said rear panel;

a transparent cover receivable in said open end of said clock base;

a frame removably secured around said open end of said clock base to removably secure said transparent cover to said clock base;

a first clock dial card mounted in said clock base over said rear panel and visible through said transparent cover; and a second clock card separate from said first clock card mounted in said clock base between said first clock card and said rear panel so as not to be visible through said transparent cover, said first and second clock dial cards being interchangeable so that, after removing said removable frame and said transparent cover, said second clock dial card can be placed in a visible position and said first clock dial card placed in a position that is not visible through said transparent cover when said transparent cover is thereafter mounted on said clock base.

2. A changeable wall clock as defined in claim 1 wherein said first and second clock dials are similarly shaped but visually dissimilar to each other.

3. A changeable wall clock as defined in claim 2 wherein said first and second clock dials are mounted in said clock base by means of one or more tabs formed on each of said first and second clock dials and one or more slots formed in said base for receiving said tabs to secure said first and second clock dials in said base.

4. A changeable wall clock as defined in claim 2 wherein each of said first and second clock dials comprises a substantially circular disc and wherein each of said discs is of substantially the same size and shape.

5. A changeable wall clock as defined in claim 4 wherein each of said tabs is of substantially rectangular plan form and extends substantially radially outwardly from said circular disc.

6. A changeable wall clock system comprising:

a clock base having a rear panel and an open end opposite said rear panel;

a clock movement mounted to said clock base adjacent said rear panel;

a transparent cover receivable in said open end of said clock base;

a plurality of frames each being removably securable around said open end of said clock base to removably secure said transparent cover to said clock base, each of said frames being visually distinct from the other of said frames;

a first clock dial card mounted in said clock base over said rear panel and visible through said transparent cover; and a second clock card separate from and visually distinct from said first clock card mounted in said clock base between said first clock card and said rear panel so as not to be visible through said transparent cover, said first and second clock dial cards being interchangeable so that, after removing said removable frame and said transparent cover, said second clock dial card can be placed in a visible position and said first clock dial card placed in a position that is not visible through said transparent cover when said transparent cover is thereafter mounted on said clock base, said frames also being interchangeable so that the visual appearance of the wall clock can be altered through selection and use of particular ones of said frames.

7. A changeable wall clock system as defined in claim 6 wherein said first and second clock dials are similarly shaped but visually dissimilar to each other.

8. A changeable wall clock system as defined in claim 7 wherein said first and second clock dials are mounted in said clock base by means of one or more tabs formed on each of said first and second clock dials and one or more slots formed in said base for receiving said tabs to secure said first and second clock dials in said base.

9. A changeable wall clock system as defined in claim 8 wherein each of said first and second clock dials comprises a substantially circular disc and wherein each of said discs is of substantially the same size and shape.

10. A changeable wall clock system as defined in claim 9 wherein each of said tabs is of substantially rectangular plan form and extends substantially radially outwardly from said circular disc.

* * * * *